US010208910B2

(12) United States Patent
Hogrefe et al.

(10) Patent No.: US 10,208,910 B2
(45) Date of Patent: Feb. 19, 2019

(54) MOTOR VEHICLE HEADLAMP HAVING A TWO-CHAMBER REFLECTION SYSTEM

(71) Applicant: Automotive Lighting Reutlingen GmbH, Reutlingen (DE)

(72) Inventors: Henning Hogrefe, Walddorfhaeslach (DE); Markus Kratzer, Unterensingen (DE); Sebastian Schildmann, Reutlingen (DE); Michael Scholl, Gomaringen (DE); J. Tobias F. Wagner, Ferndale, MI (US)

(73) Assignee: Automotive Lighting Reutlingen GmbH, Reutlingen (DE)

( * ) Notice: Subject to any disclaimer, the term of this patent is extended or adjusted under 35 U.S.C. 154(b) by 476 days.

(21) Appl. No.: 14/976,431

(22) Filed: Dec. 21, 2015

(65) Prior Publication Data

US 2016/0186952 A1 Jun. 30, 2016

(30) Foreign Application Priority Data

Dec. 22, 2014 (DE) ..... 10 2014 226 881

(51) Int. Cl.

| | |
|---|---|
| ***F21S 41/32*** | (2018.01) |
| ***F21S 41/33*** | (2018.01) |
| ***F21S 41/147*** | (2018.01) |
| ***F21S 41/663*** | (2018.01) |

(52) U.S. Cl.

CPC ..... *F21S 41/147* (2018.01); *F21S 41/321* (2018.01); *F21S 41/333* (2018.01); *F21S 41/663* (2018.01)

(58) Field of Classification Search

CPC ..... F21S 41/36; F21S 41/663; F21S 41/147

USPC ..... 362/517

See application file for complete search history.

(56) References Cited

U.S. PATENT DOCUMENTS

| | | | | |
|---|---|---|---|---|
| 7,306,352 | B2 * | 12/2007 | Sokolov | G02B 5/12 362/297 |
| 9,897,274 | B2 * | 2/2018 | Yamamoto | F21S 41/36 |
| 2006/0120094 | A1 * | 6/2006 | Tsukamoto | F21S 41/143 362/518 |
| 2007/0279924 | A1 | 12/2007 | Yagi | |

(Continued)

FOREIGN PATENT DOCUMENTS

| | | | |
|---|---|---|---|
| DE | 102007025337 | A1 | 12/2007 |
| DE | 102010045847 | A1 | 3/2012 |
| JP | 2011129283 | A | 6/2011 |

*Primary Examiner* — William N Harris

(74) *Attorney, Agent, or Firm* — Howard & Howard Attorneys PLLC

(57) ABSTRACT

A motor vehicle headlamp having a first reflection module, including a first reflector, a first group of LED chips and a second group of LED chips, having a second reflection module, which comprises a second reflector, a third group of LED chips and a fourth group of LED chips, and having a control circuit, which is configured to control the current flow through the light emitting diodes, and which is configured to activate the LED chips of the first group together with the LED chips of the fourth group, wherein the LED chips of the second group and the LED chips of the third group are deactivated. The control circuit activates the LED chips of the second group together with the LED chips of the third group, wherein the LED chips of the first group and the LED chips of the fourth group are deactivated.

16 Claims, 4 Drawing Sheets

(56) References Cited

U.S. PATENT DOCUMENTS

| | | | | |
|---|---|---|---|---|
| 2009/0097247 | A1* | 4/2009 | Tseng | F21K 9/00 362/241 |
| 2012/0294024 | A1* | 11/2012 | Peck | B60Q 1/06 362/516 |
| 2014/0355286 | A1* | 12/2014 | Arita | F21S 41/19 362/516 |

* cited by examiner

MOTOR VEHICLE HEADLAMP HAVING A TWO-CHAMBER REFLECTION SYSTEM

CROSS-REFERENCE TO RELATED APPLICATIONS

The present application claims priority to and all the benefits of German Patent Application No. 10 2014 226 881.8, filed on Dec. 22, 2014, which is hereby expressly incorporated herein by reference in its entirety.

BACKGROUND OF THE INVENTION

1. Field of the Invention

The invention relates to an LED headlamp, which generates a low-beam light distribution with a reflection system, and which can also be switched to generate a light distribution that is not dimmed.

2. Description of the Related Art

A system of this type is disclosed, for example, in JP 2011129283. Furthermore, a system is disclosed in DE 10 2007 025 337, in which special LED chip combinations are specified. DE 10 2010 045 847 represents a further application in this field. The generation of a light distribution using a reflection system is understood to mean a generation thereof that can be achieved without expensive and heavy projection lenses.

Looking at known systems, there is also still a need for a motor vehicle headlamp using a semiconductor light source like light emitting diodes (LED), which is inexpensive and which provides both a dimmed light distribution as well as a high-beam light distribution, exhibiting a good performance level regarding the generated light volume and the quality of the light distribution. The light volume refers to the illumination of the region in front of the headlamp with a specific luminous flux (e.g. 1,000 lumen). The quality is measured according to criteria such as homogeneity of the brightness, the avoidance of a glare, a sharpness of the light/dark borders, a limited brightness gradient in the transition from bright to dark in the lateral edge regions, a good lateral illumination, and so on. One example of a dimmed light distribution is a known low-beam light distribution. One example of a non-dimmed light distribution is a known high-beam light distribution.

A double headlamp is distinguished by two light exit surfaces for each headlamp, this being for each side of the vehicle. With an adjacent arrangement of the light exit surfaces of a conventional headlamp, the light exit surface for the low beam light is disposed further to the outside than the light exit surface for the high-beam light. With conventional double headlamps, the low-beam light is generated by only the outer reflectors. Double headlamps are also known in which an outer reflector and an associated inner reflector have at least one different signal image (e.g. differently disposed brighter and darker regions of the respective light exit surface).

With the invention, however, both reflectors of a headlamp have a basically identical signal image when the low-beam light is activated, seen from a central direction, and also that the entire reflector surface, thus the sum of the reflector surfaces, appears to be illuminated in a uniform manner.

SUMMARY OF THE INVENTION

The motor vehicle headlamp according to the invention has a first reflection module, having a first reflector, a first group of LED chips and a second group of LED chips, wherein the LED chips of the second group are disposed offset to the LED chips of the first group in the main beam direction of the first reflector.

The motor vehicle headlamp furthermore has a second reflection module, having a second reflector, a third group of LED chips and a fourth group of LED chips, wherein the LED chips of the fourth group are disposed offset to the LED chips of the third group in the main beam direction.

Furthermore, the headlamp has a control circuit, which is configured for controlling the current flow through the LED chips, and which is configured to activate the LED chips of the first group together with the LED chips of the fourth group in a first switching state, and which control circuit is configured to activate the LED chips of the second group together with the LED chips of the third group in a second switching state, wherein the LED chips of the first group and the LED chips of the fourth group are deactivated in the second switching state.

A high-beam light is generated with the activation of the LED chips of the first group together with the LED chips of the fourth group, for example. A low beam light is generated with the activation of the LED chips of the second group together with the LED chips of the third group, for example, wherein the LED chips of the first group and the fourth group that generate the high-beam light are deactivated.

A preferred embodiment is distinguished in that the control device is configured to activate and/or leave the LED chips of the second group and/or the LED chips of the third group in an activated state when the LED chips of the first group, together with the LED chips of the fourth group are activated. As a result, a high-beam light is generated that is supplemented by a least one of the two low-beam light components.

An activation is understood to mean a control of the current flow in which the light emitting diodes appear to be illuminated for a human sense of sight. Light emitting diodes are frequently switched on and off with a duty cycle having a higher frequency, wherein the human sense of sight only registers an average brightness. Such frequencies are typically higher than 100 Hz, wherein up to 200 Hz is typical.

Because the control circuit is configured to activate the LED chips of the first group of LED chips, which illuminate the first reflector, together with the LED chips of the fourth group of LED chips, which illuminate the second reflector, light is emitted from the light exit surfaces of both reflection modules, such that both light exit surfaces appear to be brightly illuminated. As a result, a more attractive signal image is generated than with a conventional double headlamp. Because the LED chips of the second group of LED chips, which illuminate the first reflector, and the LED chips of the third group of LED chips, which illuminate the second reflector, are switched off thereby (or deactivated, respectively), a first light distribution is generated, for a high-beam light distribution, for example.

Because the control circuit activates the LED chips of the second group of LED chips, which illuminate the first reflector, together with the LED chips of the third group of LED chips, which illuminate the second reflector, wherein the LED chips of the first group of LED chips and the LED chips of the fourth group of LED chips are deactivated, a second light distribution is provided, e.g. a low-beam light distribution, wherein an attractive signal image is likewise obtained thereby, in that here as well, the light exit surfaces of both reflection modules contribute to the generation of the light distribution. This is different than with conventional double headlamps, in which normally only the outer headlamps, or the respective outer reflection modules, but not the respective inner headlamps, or the respective inner reflection modules, contribute to the generation of the low-beam light.

Because both reflection modules of a headlamp contribute to the generation of the low-beam light distribution as well as the generation of the high-beam light distribution, each of the specified partial light distributions can be constructed from two individual partial light distributions, which have individual, different properties due to their generation through different reflection modules, and which provide optimized light distributions when superimposed on one another.

The partial light distributions generated by one reflection module are wider, for example, than the partial light distributions generated by the other reflection module. It is thus possible to generate low-beam light distributions and high-beam light distributions with high brightness levels in the center and wider lateral illumination in a simple manner, inexpensively and having attractive signal images.

As a motivation for this concept, the following is explained: a bi-functional reflection system must fulfill the following requirements. On one hand, a very sharply focused light/dark border must be generated in the dimmed light distribution, wherein this should only be achieved through the interaction of the reflector with the LED light source. This means that the shape of the reflector must be designed such that the light distribution with a horizontal upper light/dark border can be generated using a portion of the LED chips.

On the other hand, a pronounced maximum and at the same time a homogenously diminishing light distribution having very wide lateral diffusion is desired. The light in the region in front of the headlamp, lying only 2-3° below the maximum, cannot be too strong thereby, in order to avoid glare through moisture reflection. These requirements are established through various limit values that are to be maintained.

Furthermore, for the other, not dimmed light distribution (e.g. the high-beam light distribution) a frequently even more clearly stronger maximum is required, wherein, however, a light/dark border is not required.

The same reflector surfaces, but a substantially different portion of the LED chips are to be used thereby for the generation of the dimmed light distribution as well as for the generation of the non-dimmed light distribution.

Thus, two light distributions are to be implemented with the same overall reflection surfaces, using only LED chips that are positioned such that they are slightly offset to one another, which light distributions have significantly different properties. This is a demanding challenge.

This is where the idea comes into play, in which two sub-reflectors, each having two groups of LED chips, and somewhat narrower and somewhat wider diffusion characteristics, are used, such that partial light distributions can be obtained, which can be superimposed on one another to fulfill the requirements that have been specified above. On the whole, the invention provides an inexpensive semiconductor light source motor vehicle headlamp with a reflection system having a harmonious appearance and a good range. The use of a reflection system that functions without expensive and heavy light-diffractive projection optics contributes to the low prices.

One embodiment is distinguished in that the LED chips of the first group are disposed in a row that is transverse to a main beam direction of the first reflector.

In one embodiment, the second group has fewer LED chips than the first group.

In another embodiment, the LED chips of the third group are disposed in a row that is transverse to a main beam direction of the second reflector, and wherein the fourth group has fewer LED chips than the third group.

The LED chips of the second group may be disposed in the main beam direction of the first reflector in front of the first group, and thus spaced further apart from the light exit surface of the first reflector than the first group of light emitting diodes.

Furthermore, the LED chips of the second group may be disposed in a row.

The row of LED chips of the second group may be parallel to the row of LED chips of the first group.

The fourth group may have fewer LED chips than the third group.

Furthermore, the LED chips of the fourth group may be disposed in a V-pattern, the tip of which points in the main beam direction.

In one embodiment, the number of LED chips in the first group may be the same as the number of LED chips in the third group, and the number of LED chips in the second group may be the same as the number of LED chips in the fourth group.

The partial light distributions generated by the first reflection module may be narrower in the horizontal direction than the partial light distributions generated by the second reflection module, when in an intended use.

The second reflector, through its shape, in conjunction with the arrangement of the third group of LED chips, acts to generate a partial light distribution having an upper light/dark border that runs, at least in part, horizontally, in an intended use of the headlamp.

In one embodiment, the light exit surfaces of the two reflectors have similar edge shapes and similar sizes.

The edges of the light exit surfaces may be circular, or have the same number of corners and similar side lengths.

In the case of different sizes of the light exit surfaces, the circumference of the smaller light exit surface is not smaller than 80% of the circumference of the larger light exit surface.

Further advantages can be derived from the following description, the drawings and the dependent Claims. It is to be understood that the features specified above and still to be explained below can be used not only in the respective given combinations, but also in other combinations or in and of themselves, without abandoning the scope of the present invention.

Exemplary embodiments of the invention are depicted in the drawings and shall be explained in greater detail in the following description.

BRIEF DESCRIPTION OF THE DRAWINGS

The invention will be readily appreciated as the same becomes better understood by reference to the following detailed description when considered in connection with the accompanying drawings, wherein.

DETAILED DESCRIPTION OF THE INVENTION

Figure 1:
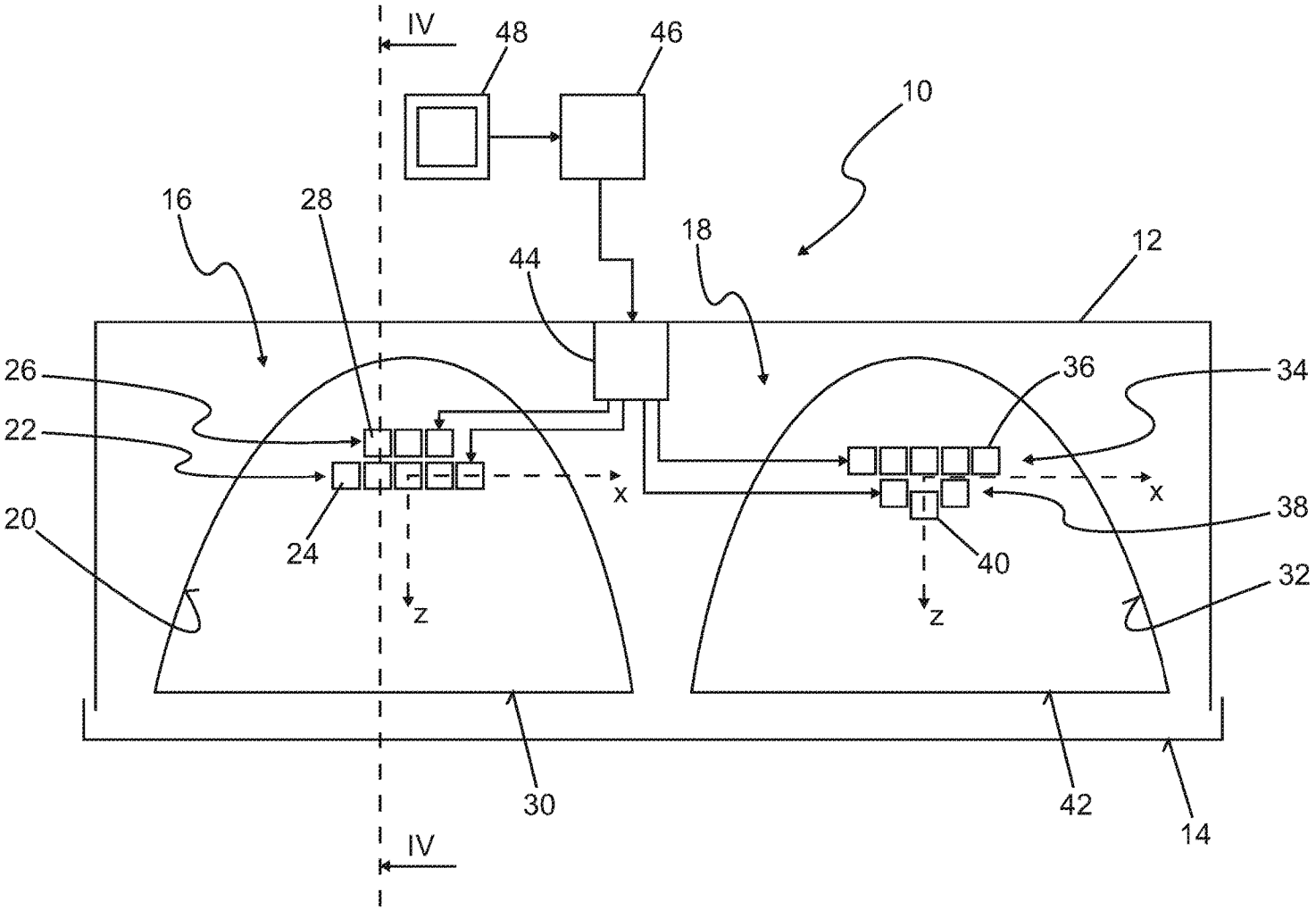
FIG. 1 shows a top view of a horizontal section of a motor vehicle headlamp.

Individually, FIG. 1 shows a top view of a horizontal section of a motor vehicle headlamp 10 having a housing 12 and a transparent cover plate 14, which covers a light exit opening of the headlamp. Directional and/or positional terms such as up, down, right, left, as well as vertical and horizontal, always pertain in this application to an intended use of a headlamp in a motor vehicle. A first reflection module 16 and a second reflection module 18 are disposed inside the housing.

The first reflection module has a first reflector 20, a first group 22 of LED chips 24, and a second group 26 of LED chips 28. An LED chip is understood in this application to be a single, coherent light exit surface of a light emitting diode, wherein numerous such light exit surfaces can lie on a common substrate, wherein the light emissions thereof can be controlled collectively. The LED chips 24 of the first group 22 are disposed in a row that is transverse to a main beam direction z of the first reflector 20.

The second group 26 has fewer LED chips than the first group 22. The LED chips 28 of the second group 26 are disposed offset to the LED chips 24 of the first group 22 in the main beam direction z. In the depicted design, the LED chips 28 of the second group are disposed in the main beam direction of the first reflector 20 in front of the first group 22. They are thus, in particular, disposed further apart from the light exit surface 30 of the first reflector 20 than the first group 22 of light emitting diodes. The first group 22 may have five LED chips here, and the second group 26 may have three LED chips here. The LED chips of the second group are also disposed in a row here. The row of LED chips of the second group is parallel to the row of LED chips of the first group.

The second reflection module has a second reflector 32, a third group 34 of LED chips 36, and a fourth group 38 of LED chips 40. The LED chips 36 of the third group 34 are disposed thereby in a row that is transverse to a main beam direction z of the second reflector 32. The fourth group 38 has fewer LED chips than the third group 34. The LED chips 40 of the fourth group 38 are disposed offset to the LED chips 36 of the third group 34 in the main beam direction z.

In the depicted design, the LED chips 36 of the third group 34 are disposed in the main beam direction z of the second reflector 32 in front of the fourth group 38.

They are thus disposed, on the whole, further apart from the light exit surface 42 of the second reflector 32 than the fourth group 38 of light emitting diodes 40. The third group 34 has the preferred number of five LED chips 36 here, and the fourth group 38 has the preferred number of three LED chips here.

The LED chips 40 of the fourth group 38 are disposed in a V-pattern here, the tip of which points in the main beam direction z.

The headlamp has a control circuit 44, which is configured for controlling the current flow through the light emitting diodes 24, 28, 36, 40. The control circuit 44 is preferably configured, in particular, to activate the LED chips of the first group of LED chips of the first reflection module together with the LED chips of the fourth group of LED chips of the second reflection module, wherein the LED chips of the second group of LED chips of the first reflection module and the LED chips of the third group of LED chips of the second reflection module are deactivated.

The control circuit 44 is furthermore configured to activate the LED chips of the second group 26 of LED chips 28 of the first reflection module 16 together with the LED chips 36 of the third group 34 of LED chips of the second reflection module 18, wherein the LED chips 24 of the first group 22 of LED chips of the first reflection module 16 and the LED chips 40 of the fourth group 38 of LED chips of the second reflection module 18 are deactivated.

The control circuit 44 can be disposed internally or externally on the headlamp 10. It is configured, in particular, programmed, to control the luminous flux of the individual semiconductor light sources 24, 28, 36, 40, preferably in groups, comprising, in particular, the activation and deactivation thereof, and the control of the brightness. This control circuit 44 is a component of the invention, independently of its position.

The control circuit 44 is preferably controlled in an intended use of the headlamp on its part, by a superordinated control device 46, which receives a driver signal for a light switch 48, for example, for this. The superordinated control device 46 sends a signal to the control circuit 44, regarding whether and, if applicable, which light distribution should be generated, and the control circuit 44 controls the individual semiconductor chips 24, 28, 36, 40 thereupon, such that the desired light distribution is obtained.

Figure 2:
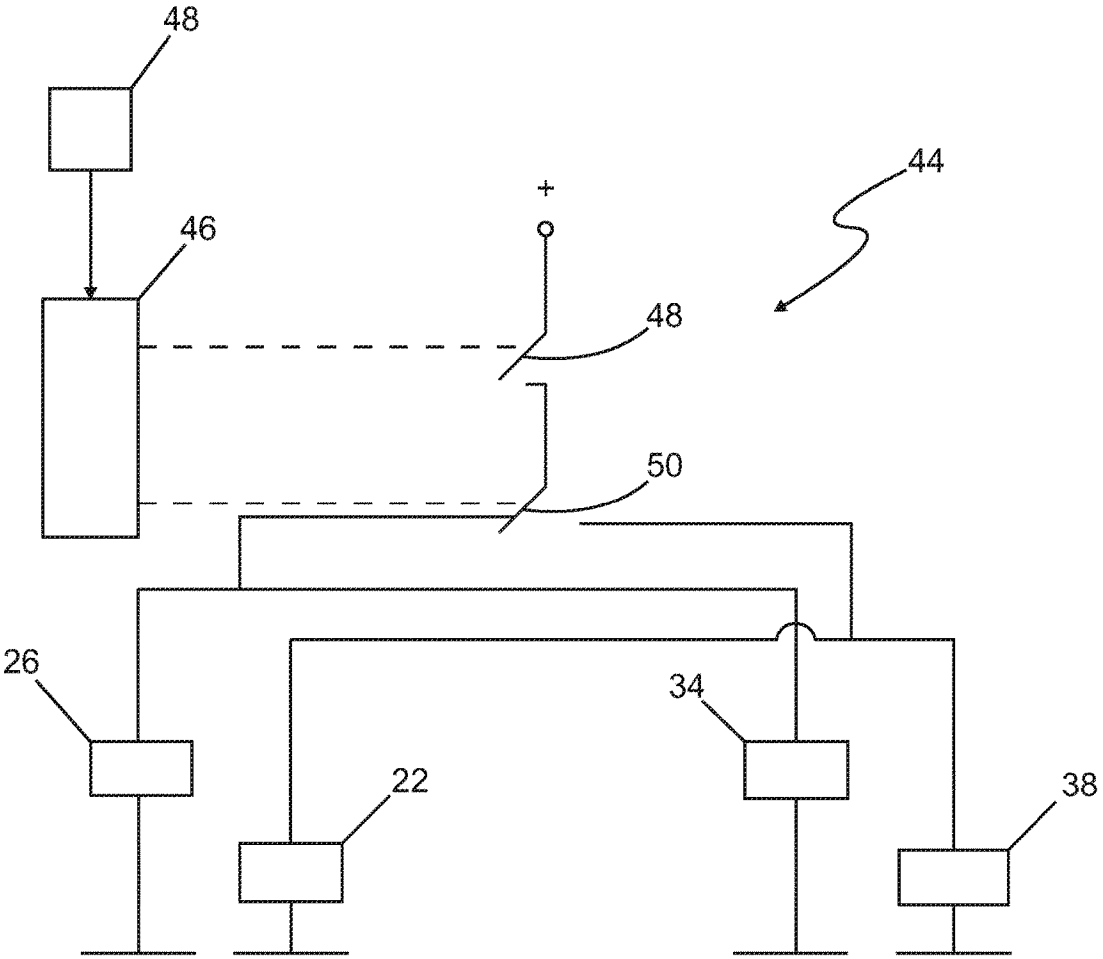
FIG. 2 shows an exemplary embodiment of a control circuit.

FIG. 2 shows an exemplary embodiment of the control circuit 44 together with the four groups 22, 26, 34, 38 of LED chips and two switches 48, 50, with which the control device 44 controls the light emission of the four groups of LED chips. The first switch 48 serves to activate a current supply for the semiconductor light sources, and the second switch 50 serves to activate and deactivate either the first group 22 of LED chips together with the fourth group 38 of LED chips, or to activate and deactivate the second group 26 of LED chips together with the third group 34 of LED chips. The first switch 48 can, for example, be activated with a duty cycle for setting an average brightness.

When the first switch 48 is engaged, a current flows from a supply potential (+) to the ground via the first switch 48, the second switch 50 and two of the four groups of LED chips. In doing so, depending on the switching setting of the second switch 50, either the first group 22 together with the fourth group 38 emits light, wherein the second group 26 and the third group 34 remain inactive, or the second group 26 and the third group 34 emit light, wherein the first group 26 and the fourth group 38 remain inactive.

A motor vehicle headlamp 10 having a reflection system with two reflection modules 16, 18 is provided by the invention. Each reflection module has a reflector and an associated LED light source. Both reflection modules contribute to both the generation of the dimmed lighting function as well as the generation of the high-beam lighting function. Both reflection modules have LED light sources with numerous LED chips. The LED chips of each of the two reflection modules are disposed in two groups, respectively.

Both light sources may each have a row of LED chips oriented longitudinally along a straight line as a group, that is transverse to the reflector axis, or to the main beam direction of the reflector, which is substantially aligned with the reflector axis. With the design according to FIG. 1, these are the first group 22 and the third group 34. This number of LED chips may be greater than or equal to four (If the performance of available LED chips improves drastically through future technological advances, at least 3.).

A further group of LED chips of a reflection module, which has a lesser number of LED chips, has a (smaller) spacing to the group of LED chips having a greater number of LED chips in a reflection system in the main beam direction (direction of the reflector axis), wherein these further groups lie, in one case in front of, and in one case behind the first group in the main beam direction of the reflection module. The further groups are the second group 26 and the fourth group 38 in the design according to FIG. 1. With the first reflection module 16, the further group having a lower number of chips (the second group 26 there), lies in front of the group that has a greater number of chips (the first group 22 there). In the second reflection module 18, the further group having a lower number of chips (the fourth group 38 there), lies behind a group that has a greater number of chips (the third group 34 there).

The respective further group (in this case, groups 26 and 28) may also be oriented transverse to the axis. The number of LED chips in the respective group 22, 34 may be greater than the number of LED chips in the respective further group 26, 38.

With the design according to FIG. 1, the number of LED chips of the third group 34 may be greater than the number of LED chips in the fourth group 38. The number of LED chips in the first group may be equal to the number of LED chips in the third group 34. The number of LED chips in the second group 26 may be equal to the number of LED chips in the fourth group 38. This applies analogously in general, in which the first group and the third group represent the one group with the greater number of chips, and the second group and the fourth group represent the further groups having a lower number of chips.

Figure 3:
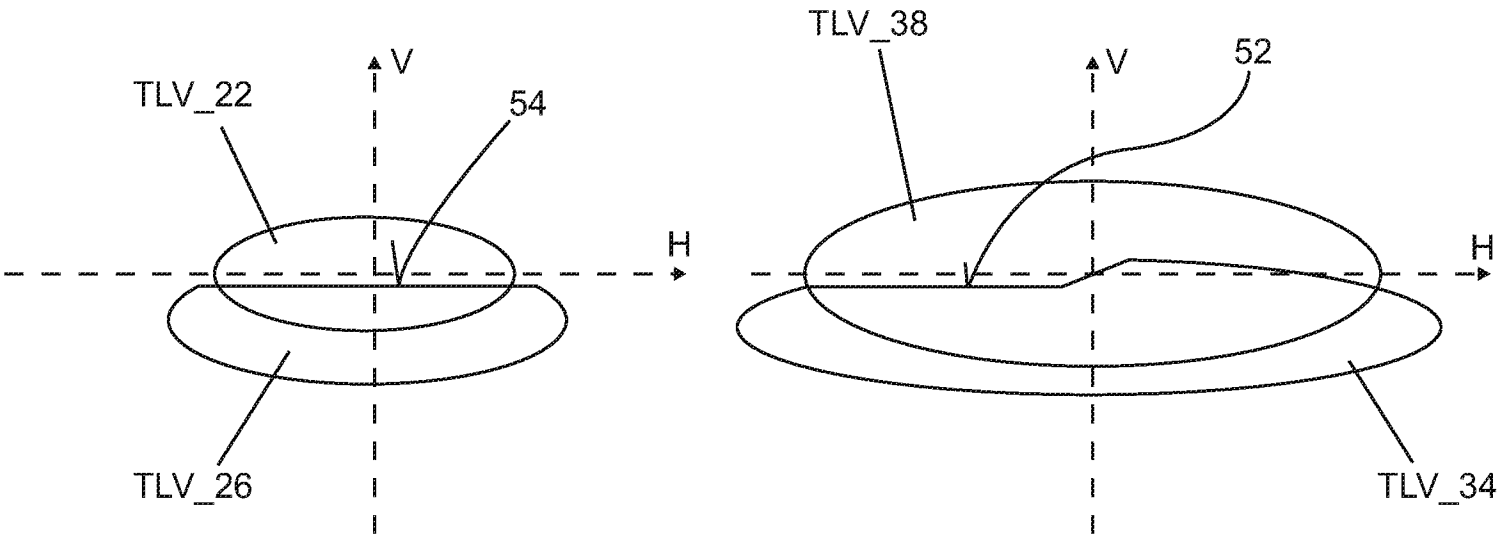
FIG. 3 shows partial light distributions generated by the reflection system.

FIG. 3 shows a partial light distribution generated by the reflection systems. The reflection systems are configured as follows, with respect to the interaction of their reflectors and the associated groups of LED chips: The first group 22 of LED chips of the first reflection system 16 generates, in interacting with the first reflector 20, a partial light distribution TLV_22, which, in particular in the horizontal direction, is comparatively less wide, and is not dimmed, e.g. as a contribution to a high-beam light distribution. This partial light distribution TLV_22 has a comparatively strongly formed maximum, due to its limited width. A non-dimmed partial light distribution TLV_38 generated by the second reflection system 18 with the fourth group 38 of LED chips serves here as a comparison standard, for example.

The non-dimmed partial light distribution TLV_22 generated by the first group 22 of LED chips of the first reflection module 16, in interacting with the first reflector 20, is supplemented by the further partial light distribution TLV_38, which is generated by the fourth group 38 of the second reflection module 18, in interacting with the second reflector 32, that is activated at the same time in order to form the overall, non-dimmed light distribution. This further partial light distribution TLV_38 is a non-dimmed partial light distribution, which is wider, in comparison with the other non-dimmed partial light distribution TLV_22, in particular in the horizontal direction H, and has a comparatively less bright maximum in its central region.

The central region lies around the intersection of the vertical axis V and the horizontal axis H. The intersection lies fundamentally in the extension of the main beam direction in front of the vehicle in an intended use of the headlamp, wherein the z-axis is perpendicular to the plane defined by the axes V and H. It is also conceivable to also activate a dimmed partial light distribution TLV_34 as an additional, more widely diffused component of a high-beam light distribution when in the high-beam setting. Alternatively or additionally, it is also conceivable to also activate the dimmed partial light distribution TLV_26 when in the high beam setting, as an additional, concentrated component of a high-beam light distribution.

The third group 34 of LED chips of the second reflection module 18 generates, in contrast, a dimmed partial light distribution TLV_34, having a comparatively greater expansion, in particular in the horizontal direction. The comparison standard in this case is, in particular, the width of a dimmed light distribution TLV_26 generated by the first reflection module by activating the second group 26 of LED chips. By its shape, the second reflector 32, in conjunction with the arrangement of the third group 34 of LED chips, acts to generate a partial light distribution TLV_34 having an upper and at least partially, horizontally running light/dark border 52, in the intended use of the headlamp.

This is achieved in that the second reflector 32 is shaped such that its reflection images, thus the images of the light exit surfaces of the LED chips of the third group 34 of LED chips, which projects the reflector 32 in its foreground, does not extend beyond a specific line.

Each surface element of the reflector 32 projects such a reflection image, which can be projected, for example, onto a screen. The position of the reflection image on the screen can be predetermined by the shape of the reflector. It also possible to determine thereby, that all or at least most of such reflection images, for example, lie on one side of a specific line on the screen, which results, with the sum of all of the reflection images, in the light distribution having the light/dark border. With an intended use of the headlamp, the substantially horizontal light/dark border basically lies at the level of the horizon in front of the vehicle. This applies analogously to the first reflector 20 and the second group 26.

The dimmed partial light distribution TLV_34 generated by the second reflection module is supplemented by activating the second group 26 of LED chips of the first reflection system 16 for the overall light distribution TLV_26 plus TLV_34 of the dimmed function, wherein the first reflection module 16 in this case generates a dimmed partial light distribution TLV_26 having weaker intensities and a basically straight, horizontal upper border 54, which is comparatively less wide, in particular, in the horizontal direction. The upper border is preferably designed as a sharply focused light/dark border. Because the two reflectors 20, 32 are fundamentally identical, aside from slight differences in the horizontal diffusion widths and the LED assignments, as stated above, it is possible to fulfill the requirements pertaining to the signal images of both reflectors.

It is preferred that the light exit surfaces 30, 42 of the two reflectors 20, 32 have edge shapes and sizes that are similar to one another. A similarity of the edge shapes is obtained, for example, when the edges of the light exit surfaces are circular or have the same number of corners, and similar edge lengths. Similar sizes are obtained when, if the light exit surfaces 30, 42 are of different sizes, the circumference of the smaller light exit surface is not less than 80% of the circumference of the larger light exit surface.

The exemplary embodiment depicted in FIG. 1 shows the horizontal adjacent reflectors of the first reflection module and the second reflection module, as they are depicted in an intended use when viewed from below. The LED chips are enlarged in the depiction in relation to the rest of the components. The z-axis points in the direction of travel. The LED light sources are disposed on an upper side of the reflectors, such that the reflection surfaces of the reflectors extend downward from the position of the LED chips. This corresponds to the arrangement of the lower reflection module 16 in FIG. 4.

Figure 4:
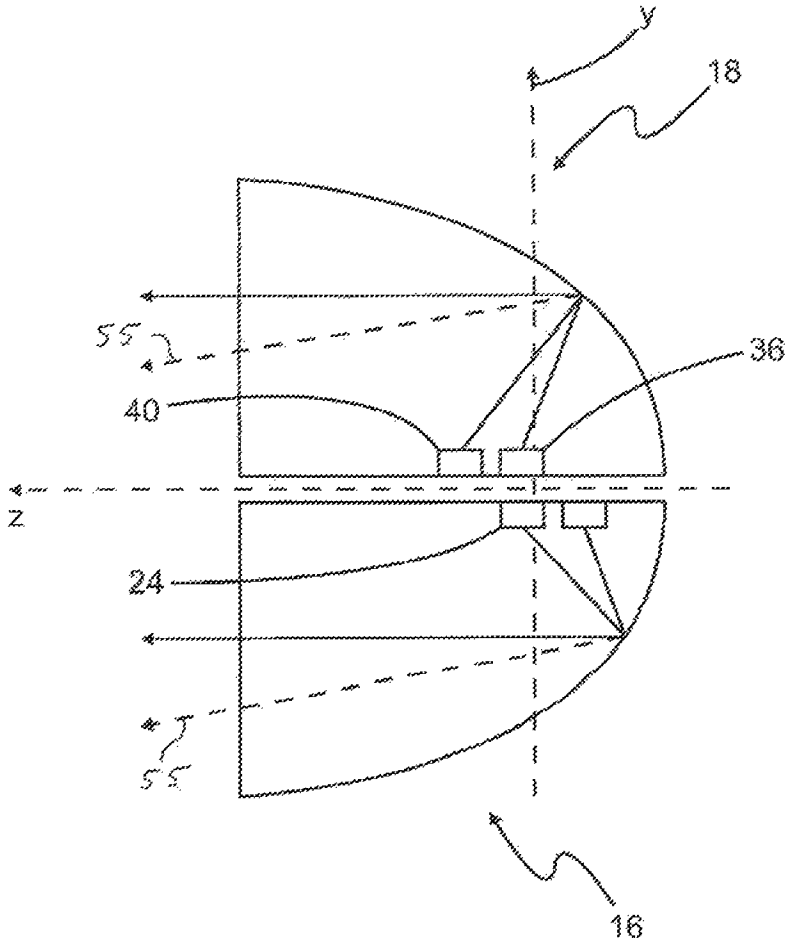
FIG. 4 shows a cross section of the subject matter of FIG. 1, as a component of a further exemplary embodiment.

FIG. 4 thus shows, in its lower half, a cross section of the subject matter of FIG. 1, along the line IV-IV in FIG. 1. The light 55 emitted downward into the half space from the LED chips 28 of the second group 26 and the LED chips 24 of the first group 22 is collected by the concave mirror reflector 16 and projected into the foreground of the of the headlamp, bundled about a main beam direction z.

In an alternative design to the horizontal arrangement of the reflection module according to FIG. 1, the headlamp is constructed such that the reflection surfaces extend upward, away from the LED chips. This is depicted in the upper half of FIG. 4, which shows a section of a second reflection module 18, which would lie parallel to the section IV-IV in FIG. 1.

The reflectors, including the LED light sources, can also be disposed vertically, above one another (preferably then with the LED chips facing one another) or diagonally offset to one another. This is depicted on the whole in FIG. 4.

The LED chips of the second group 26 can be disposed such that they lie transverse in a line (such as those of the first group 22), but they can also be disposed such that they lie transverse and offset to one another (as indicated in FIG. 1 with the reflector 32). This positioning is preferably implemented for the fourth group 38 in the second reflection module 18. With the second group 26 and the fourth group 38, LED chips can also lie at a greater spacing to the z-axis, e.g. basically at the spacing that the outer LED chips of the first group 22, or the third group 34, respectively, has to the z-axis. The arrangement of the LED chips can also be asymmetrical, or at a diagonal to the z-axis.

In order to be able to freely locate the individual LED chips, especially the second LED group 26 and the fourth LED group 38, these groups may be comprised of individual chips. On the other hand, corresponding linear multiple chip light sources, such as OSLON Black Flat 1×5 are used for the first group 22 and the third group 34. A special LED construction is also used for first group, because it must be possible to dispose the LED chips of the second group relatively close to the first group.

It is also conceivable to use light sources with which both LED chip groups of a reflection module are disposed on an integrated substrate, and thus covered by the manufacturer of the light sources. These integrated light sources can be specifically different or identical for each of the two reflection modules thereby. If they are identical, the same light sources can be used for both reflectors, but in different orientations.

The LEDs of the second group 26 and the fourth group 38 can also be disposed in the shape of diamond, thus with their edges not perpendicular and parallel to the x- and z-axes, but rotated approximately 45°. Other LED chip shapes are also conceivable. Individual chips can also be disposed such that they are rotated within a group.

The focal region, to the extent that one cans speak of such with freeform reflectors, is preferably basically in the center in the first group for the first reflection module 16 and is slightly behind the third group 34, or close to the front edge, closer to the light exit surface 42 of the reflector 32, of the light exit surfaces of the LED chips of the third group 34, respectively. In FIG. 1, these positions are aligned, in each case, with the respective intersection of the x-axis and the z-axis.

In one design, in which the reflector lies above the LED chips in an intended use of the headlamp, the position of the chip-row depicted in FIG. 1 must be mirror-reversed over the z-axis for both reflectors, such that, for example, for reflector 20, the group 26 having three (or fewer) chips then lies closer to the exit surface 30 than the group 22 having five (or more) chips.

In one embodiment, the second reflector, with respect to the arrangement of the third group of LED chips, is shaped such that with activated LED chips of the third group, a comparatively sharply focused light/dark border is obtained. The comparison standard here is the sharpness, thus the gradient of the brightness transverse to the light/dark border of the upper limit of the partial light distribution generated by the first reflection module when the LED chips of the second group 26 are activated. This upper limit 54 also lies slightly below the sharply focused light/dark border 52 of the light/dark border generated by the second reflection module in a preferred design.

In the case of the low-beam light function, only the second reflection module 18 generates the central, sharply focused light/dark border 52 having the diagonal rise in the bright region on one's own side of the roadway that is typical for the low-beam light distribution.

In another embodiment, when the non-dimmed light function is generated, at least one or both dimmed partial light distributions are generated as well, such that they are superimposed on the non-dimmed partial light distributions, and result, in particular, in a reinforced illumination of the region lying beneath the horizon. This can be realized by an appropriate design for the control circuit 44. In this context, it should be noted that the control circuit 44 according to FIG. 1 represents, with its group-individual control paths, a group-individual control.

In one embodiment, one group, or individual LED chips, are assigned one or more attachment lenses, which are configured to collimate and orient the light from these LED chips, in order to redirect it to specific, appropriately shaped, reflector sub-regions, in order to more easily or better fulfill certain requirements, without compromising other reflector sub-regions. As such, one could, for example, optimize a sub-region of the reflector surface for generating the maximum in the first reflector, while the rest basically assumes the task of distributing the light in terms of areas for the light emitted from the second group. It should be ensured here, however, that the signal image is not distorted by this too much.

The invention has been described in an illustrative manner. It is to be understood that the terminology which has been used is intended to be in the nature of words of description rather than of limitation. Many modifications and variations of the invention are possible in light of the above teachings. Therefore, within the scope of the appended claims, the invention may be practiced other than as specifically described.

The invention claimed is:

1. A motor vehicle headlamp having a first reflection module, which comprises a first reflector, a first group of LED chips and a second group of LED chips, wherein the LED chips of the second group are disposed offset to the LED chips of the first group in a main beam direction (z) of the first reflector, a second reflection module, which comprises a second reflector, a third group of LED chips, and a fourth group of LED chips, wherein the LED chips of the fourth group are disposed offset to the LED chips of the third group in a main beam direction of the second reflector, and a control circuit, which acts to control the current flow through the LED chips, and which activates the LED chips of the first group together with the LED chips of the fourth group in a first switching state, said control circuit activates the LED chips of the second group together with the LED chips of the third group when in a second switching state, wherein the LED chips of the first group and the LED chips of the fourth group are deactivated in the second switching state and wherein the LED chips of the second group are disposed at a greater spacing to a light exit surface of the first reflector than the LED chips of the first group.

2. The headlamp as set forth in claim 1, wherein the control circuit activates the LED chips of the second group and the LED chips of the third group, or leaves them in an activated state, when the LED chips of the first group are activated together with the LED chips of the fourth group.

3. The headlamp as set forth in claim 1, wherein the LED chips of the first group are disposed in a row transverse to the main beam direction (z) of the first reflector.

4. The headlamp as set forth in claim 1, wherein the second group has fewer LED chips than the first group.

5. The headlamp as set forth in claim 1, wherein the LED chips of the third group are disposed in a row transverse to the main beam direction (z) of the second reflector, and wherein the fourth group has fewer LED chips than the third group.

6. The headlamp as set forth in claim 1, wherein the LED chips of the second group are disposed in a row.

7. The headlamp as set forth in claim 6, wherein the row of LED chips of the second group is parallel to a row of LED chips of the first group.

8. The headlamp as set forth in claim 1, wherein the LED chips of the fourth group are disposed in a V-shape, a tip of which points in the main beam direction (z) of the second reflector.

9. The headlamp as set forth in claim 1, wherein the number of LED chips in the first group is equal to the number of LED chips in the third group and the number of LED chips in the second group is equal to the number of LED chips in the fourth group.

10. The headlamp as set forth in claim 1, wherein partial light distributions (TLV_22, TLV_26) generated by the first reflection module, in an intended use, are narrower in a horizontal direction than partial light distributions (TLV_34, TLV_38) generated by the second reflection module.

11. The headlamp as set forth in claim 1, wherein the second reflector is configured, by its shape, in conjunction with the arrangement of the third group of LED chips, to generate a partial light distribution (TLV_34) having an upper, and at least partially horizontally running, light/dark border with an intended use of the headlamp.

12. The headlamp as set forth in claim 1, wherein light exit surfaces of the two reflectors have identical edge shapes and sizes.

13. The headlamp as set forth in claim 1, wherein edges of light exit surfaces of the two reflectors are circular, or have a same number of corners and identical side lengths.

14. The headlamp as set forth in claim 1, wherein in a case of different sizes of the light exit surfaces of the two reflectors, a circumference of a smaller light exit surface is not less than 80% of a circumference of a larger light exit surface.

15. The headlamp as set forth in claim 1, wherein the control circuit activates the LED chips of the second group or leaves them in an activated state, when the LED chips of the first group are activated together with the LED chips of the fourth group.

16. The headlamp as set forth in claim 1, wherein the control circuit activates the LED chips of the third group, or leaves them in an activated state, when the LED chips of the first group are activated together with the LED chips of the fourth group.

* * * * *